US011702874B2

(12) United States Patent
Schneider et al.

(10) Patent No.: US 11,702,874 B2
(45) Date of Patent: Jul. 18, 2023

(54) HINGE FOR CONNECTING A MOVABLE FURNITURE PART IN A MOVABLE MANNER TO A BASIC FURNITURE STRUCTURE

(71) Applicant: Grass GmbH, Reinheim (DE)

(72) Inventors: Gabriele Schneider, Fränkisch-Crumbach (DE); Boris Krüdener, Kleinostheim (DE); Markus Herper, Mühltal (DE)

(73) Assignee: Grass GmbH, Reinheim (DE)

( * ) Notice: Subject to any disclaimer, the term of this patent is extended or adjusted under 35 U.S.C. 154(b) by 9 days.

(21) Appl. No.: 17/443,128

(22) Filed: Jul. 21, 2021

(65) Prior Publication Data

US 2022/0025686 A1 Jan. 27, 2022

(30) Foreign Application Priority Data

Jul. 23, 2020 (DE) ..... 20 2020 104 251.3

(51) Int. Cl.
*E05F 1/08* (2006.01)
*E05D 11/10* (2006.01)
*E05F 5/00* (2017.01)

(52) U.S. Cl.
CPC ..... *E05D 11/1021* (2013.01); *E05F 5/006* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20;

(Continued)

(56) References Cited

U.S. PATENT DOCUMENTS 4,449,269 A * 5/1984 Sundermeier ..... E05F 5/006 16/302
7,096,535 B2 * 8/2006 Lin ..... E05F 1/1215 16/50

(Continued)

FOREIGN PATENT DOCUMENTS

CN 203856316 U * 10/2014 ..... E05D 11/087
CN 206917483 U 1/2018

(Continued)

OTHER PUBLICATIONS

European Search Report (Application No. 21186967.2) dated Dec. 3, 2021.

(Continued)

*Primary Examiner* — Chuck Y Mah
(74) *Attorney, Agent, or Firm* — Burr Patent Law, PLLC

(57) ABSTRACT

A hinge having a hinge cup, an articulation mechanism and a hinge arm, wherein the hinge cup is connected to the hinge arm in a pivotable manner via the articulation mechanism. The articulation mechanism includes first and second articulated levers attached to the hinge cup and to the hinge arm. The first articulated lever has a first end connected to the hinge cup in a pivotable manner via a first bearing element and has a second end connected to the hinge arm in a pivotable manner via a second bearing element. The second articulated lever has a first end connected to the hinge cup in a pivotable manner via a fourth bearing element and has a second element connected to the hinge arm in a pivotable manner via a third bearing element.

14 Claims, 4 Drawing Sheets

(58) Field of Classification Search
CPC ..... E05Y 2201/21; E05Y 2201/261; E05F 5/006; E05F 5/02; E05F 5/027; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 10,214,951 | B2 * | 2/2019 | Liang | E05F 1/1215 |
| 2011/0072617 | A1 * | 3/2011 | Lin | E05F 5/006 16/298 |
| 2020/0115941 | A1 | 4/2020 | Liang et al. | |
| 2020/0149335 | A1 | 5/2020 | Stuke et al. | |

FOREIGN PATENT DOCUMENTS

| | | | | | |
|---|---|---|---|---|---|
| CN | 108412356 | A * | 8/2018 | | E05D 7/1044 |
| DE | 202006001648 | U1 * | 5/2006 | | E05D 11/1021 |
| DE | 20 2007 011 194 | U1 | 1/2009 | | |
| DE | 10 2017 114 473 | A1 | 1/2019 | | |
| EP | 3633129 | A1 * | 4/2020 | | E05D 11/087 |
| WO | WO-2011113740 | A1 * | 9/2011 | | E05F 1/1215 |
| WO | 2018/214517 | A1 | 11/2018 | | |
| WO | WO-2019238054 | A1 * | 12/2019 | | E05F 3/06 |

OTHER PUBLICATIONS

German Search Report (Application No. 20 2020 104 251.3) dated Jun. 26, 2021.

* cited by examiner

HINGE FOR CONNECTING A MOVABLE FURNITURE PART IN A MOVABLE MANNER TO A BASIC FURNITURE STRUCTURE

This application claims the benefit under 35 USC § 119(a)-(d) of German Application No. 20 2020 104 251.3 filed Jul. 23, 2020, the entirety of which is incorporated herein by reference.

FIELD OF THE INVENTION

The present invention relates to a hinge for connecting a movable furniture part in a movable manner to a basic furniture structure.

BACKGROUND OF THE INVENTION

Hinges which have a hinge cup and a hinge arm, it being possible for the hinge cup to be arranged on a movable furniture part and for the hinge arm to be arranged on a basic furniture structure, are known. The hinge here comprises an articulation mechanism, via which the hinge arm is connected in a pivotable manner to the hinge cup. The articulation mechanism comprises two articulated levers, which are attached to the hinge cup and hinge arm in each case by way of bearing elements.

SUMMARY OF THE INVENTION

The object of the present invention is to improve a hinge for a movable furniture part which is attached to a basic furniture structure.

The present invention proceeds from a hinge for connecting a movable furniture part of a piece of furniture in a movable manner to a basic furniture structure of the piece of furniture, wherein the hinge has a hinge cup, an articulation mechanism and a hinge arm, wherein the hinge cup is connected to the hinge arm in a pivotable manner via the articulation mechanism, wherein the articulation mechanism comprises a first and a second articulated lever, wherein the articulated levers are attached to the hinge cup and to the hinge arm, and, therefore, the hinge is designed in the form of a four-link hinge, wherein the first articulated lever has a first end connected to the hinge cup in a pivotable manner via a first bearing element and has a second end connected to the hinge arm in a pivotable manner via a second bearing element, wherein the second articulated lever has a first end connected to the hinge cup in a pivotable manner via a fourth bearing element and has a second end connected to the hinge arm in a pivotable manner via a third bearing element.

In the state in which the hinge has been mounted on the piece of furniture, it is advantageously the case that the hinge cup has been attached to the movable furniture part, e.g. a door, and the hinge arm has been attached to the piece of furniture, advantageously to the basic furniture structure. The hinge cup has been introduced, for example to some extent, in a depression in the piece of furniture, e.g. a door.

A closing movement of the movable furniture part from an open position into a closed position on the basic furniture structure corresponds to a closing movement of the hinge. In the closed position of the movable furniture part or of the hinge, for example part of the hinge arm and of the articulation mechanism is accommodated in the hinge cup.

The hinge cup and/or the hinge arm advantageously have/has a mount for the bearing elements, e.g. the mount is a hole. The mount is preferably formed, for example, on both sides and/or on one side of the hinge arm or hinge cup, e.g. on side parts of the hinge arm or hinge cup. The bearing element is, for example, a bolt and/or a rivet and/or a pin. The bearing element is for example inserted, riveted and/or welded through the mount on the hinge cup and/or hinge arm and through the ends of the articulated levers.

The bearing element on the hinge cup is advantageously designed in the form of a two-armed pin or two-armed rivet and/or bolt, wherein one arm, previously referred to as the first bearing element, connects the first articulated lever, and a second arm, previously referred to as the fourth bearing element, connects the second articulated lever, to the hinge cup.

The core of the present invention resides in the fact that a spring element is arranged on the second bearing element, wherein a first leg of the spring element is arranged between the first articulated lever and the second articulated lever, wherein, during a closing movement of the hinge cup relative to the hinge arm, the first leg of the spring element is supported on the first articulated lever, wherein the hinge arm comprises a housing, an adjustment element and a connecting element, wherein the adjustment element is present between the housing and connecting element, wherein the connecting element can be connected to the piece of furniture, wherein a second leg of the spring element is supported on the housing, wherein the spring element is configured so as to provide a pulling-closed force of the hinge during the closing movement of the hinge cup relative to the hinge arm.

For example, the connecting element can be connected to the piece of furniture by cutouts being present in the connecting element for mounting means, e.g. screws. Furthermore, the hinge cup has, for example, a flange for mounting on the piece of furniture, wherein mounting means, e.g. screws, can be used to arrange the hinge cup on the piece of furniture, preferably on the movable furniture part, e.g. a door.

The spring element preferably has a coil and two legs. The legs are the portions of the spring element which project from the coil. For the purpose of producing the spring element, preferably a wire can be coiled, for example, around an item, the item then being removed to create a hole. The second bearing element can preferably be inserted through this hole in the coil of the spring element, and therefore the spring element is arranged on the hinge arm, or more precisely on the housing of the hinge arm, by way of the second bearing element.

The first articulated lever is connected, for example, to the housing of the hinge arm by way of the second bearing element, and the second articulated lever is connected to the same by way of the third bearing element, wherein the mounts on the hinge arm for the bearing elements are formed, for example, on the housing of the hinge arm.

It is likewise advantageous for the first leg of the spring element to be arranged between the first articulated lever and the second articulated lever, wherein the first leg of the spring element is in contact with the first articulated lever. During the opening movement of the hinge, that is to say when the hinge cup is moved relative to the hinge arm, it is possible, for example, for the distance between the first and second articulated levers to be reduced, and, therefore, the second articulated lever advantageously, for example, comes into contact with the first leg of the spring element.

The second leg of the spring element is supported, in particular, permanently on the housing of the hinge arm, and, therefore, the second leg of the spring element is located between the housing and the first articulated lever.

The spring element is designed such that, preferably during the opening movement of the hinge, the spring element can be subjected to the action of force, and therefore, the spring element, conversely, provides a pulling-closed force during the closing movement of the hinge.

The adjustment element is preferably arranged in the housing, wherein the housing and adjustment element have cutouts. The adjustment mechanisms, e.g. screws, can preferably be accommodated in these cutouts. The adjustment mechanisms can preferably be used to adjust the left-right displacement and the height of the movable furniture part relative to the basic furniture structure.

In the case of a further essential aspect of the present invention, in a closed position of the hinge, the first articulated lever is present between a floor of the hinge cup and the second articulated lever, wherein a spring element is arranged on the second bearing element, wherein a first leg of the spring element is arranged between the first articulated lever and the second articulated lever, wherein, during a closing movement of the hinge cup relative to the hinge arm, the first leg of the spring element is supported on the first articulated lever, wherein a second leg of the spring element is supported on the hinge arm, wherein the spring element is configured so as to provide a pulling-closed force of the hinge during the closing movement of the hinge cup relative to the hinge arm.

It is also advantageous if the first articulated lever has an upper side and two side parts. The first leg of the spring element is preferably arranged between the two side parts of the first articulated lever. For example, the first articulated lever is designed such that the spring element can advantageously be partially or completely covered by the articulated lever. This advantageously makes it possible to block the view of the spring element, and the esthetics of the hinge are increased as a result.

An outer side of the upper side of the first articulated lever preferably extends along the floor of the hinge cup, in a closed position of the hinge. For example, the first leg of the spring element here is preferably arranged between an inner side of the upper side of the first articulated lever and an inner side of the second articulated lever.

For example, the first bearing element and the second bearing element are advantageously arranged in each case at the ends of the inner side of the first articulated lever. It is also advantageous if, for example, the third bearing element and the fourth bearing element are arranged at the ends of the outer side of the second articulated lever. The inner side of the second articulated lever preferably has an elevation.

It is likewise advantageous if a longitudinal extent of the one leg is shorter than the longitudinal extent of the other leg.

The spring element is advantageously formed, for example, from a wire. The wire or the legs of the spring element is/are in the form of, for example, a cylinder or a prism. It is possible here for the surface area to be round, oval, triangular, quadrilateral and/or polygonal. The height of the cylinder or of the prism corresponds preferably to the longitudinal extent of a leg of the spring element.

The leg with the shorter longitudinal extent, e.g. the second leg of the spring element, is advantageously that which is supported on the housing of the hinge arm. Furthermore, the leg with the longer longitudinal extent, e.g. the first leg of the spring element, is preferably that which is located between the first and second articulated levers. The legs of the spring element can be inflected or bent one or more times along the longitudinal extent.

It is advantageous if the spring element is a leg spring.

The leg spring is preferably a leg spring which is coiled to the left. During the opening movement of the hinge, for example, a leg of the spring element, preferably the first leg of the spring element, is deflected counter to the coiling direction, that is to say to the right.

It is also advantageous for the housing to have two side parts and an upper side, therefore the housing is U-shaped, wherein the upper side has six surfaces, wherein two surfaces of the upper side are main sides, which extend along the width and length, wherein two surfaces of the upper sides are secondary sides, which extend along the height and length, wherein two surfaces of the upper side are end sides, which extend along the width and height, and wherein the second leg of the spring element is supported on an end-side upper side of the housing.

The inner side of the upper side and the inner sides of the side parts preferably form an inner volume of the housing. The adjustment element is preferably arranged in the inner volume of the housing, and, therefore, the adjustment element is partially or completely covered by the housing. The housing can be formed in one or more parts, e.g. the sides of the housing can be formed from a respective plate. The plates are preferably made of metal.

Like the upper side of the housing, the side parts of the housing have six surfaces. Like the upper side, the side parts here have two surfaces which form the main sides, which extend along the width and length, two surfaces which form the secondary sides, which extend along the height and length, and two surfaces which form the end sides, which extend along the width and height.

The end-side upper side of the housing, on which the second leg of the spring element is supported, is preferably oriented in the direction of the hinge cup.

The upper side of the housing advantageously has a notch, wherein the second leg of the spring element butts against the notch.

Likewise advantageously, the notch is designed such that the second leg of the spring element can be supported on the notch, and, therefore, the second leg of the spring element cannot slide away out of the notch. The second leg of the spring element is preferably arranged between the notch on the upper side of the housing and the upper side of the first articulated lever. The distance here between the upper side of the housing and the upper side of the first articulated lever is greater during the closing movement of the hinge.

It is likewise advantageous for the second leg of the spring element to be present in such a manner that a longitudinal extent of the second leg extends along an end side of the upper side of the housing.

The end surface of the second leg of the spring element, the end surface corresponding to the surface area of a prism or cylinder, preferably extends along the main-side upper side of the housing.

It is also advantageous for an end surface of the second leg to be supported on the upper side of the housing, wherein the end surface of the second leg is present in a direction transverse to the a longitudinal extent of the second leg of the spring element.

The second leg of the spring element is advantageously bent, for example, at least once along the longitudinal extent of the leg.

The housing is preferably designed such that the second leg of the spring element cannot be moved in the direction of the main sides of the housing. This means that the second leg of the spring element is secured on the housing, and therefore, during an opening movement of the hinge, the spring element can be subjected to the action of force.

It is advantageous if, in the state in which the spring element has been relieved of stressing, the two legs of the spring element, these legs extending directly from the coil, enclose an angle between 90° and 180°.

The angle is preferably determined such that it is the angle enclosed between the portions of the legs which extend directly from the coil of the spring element. The angle here is preferably formed between the longitudinal extents of the legs. The angle which is enclosed between the two portions of the legs is, for example, 90°-180°, in particular 130°-160°.

Likewise advantageous is the scenario where, during movement of the hinge cup relative to the hinge arm, the spring element can be subjected to stressing, wherein the difference in the angle between the state in which the spring element has been subjected to stressing and the state in which it has been relieved of stressing changes in the range from 10° to 60°.

The difference in the angle which is enclosed by the two legs is advantageously in the range from 10°-60°, in particular, is less than 45°.

The difference in the angles can be achieved by virtue of one leg being rotated relative to the other leg in or counter to the direction of coiling. The first leg can preferably be rotated counter to the direction of coiling, wherein the second leg preferably butts at a fixed location against the notch on the upper side of the housing. The first leg of the spring element here can be changed through an angle or an angle of rotation of 10°-60°, in particular, the angle of rotation is less than 45°. It is advantageously the case that, for example, in a closed position of the hinge, the spring element has been relieved of stressing and can be subjected to stressing by the opening movement of the hinge, wherein the first leg of the spring element can be deflected through an angle or angle of rotation of 10°-60°.

It is likewise advantageous for the hinge to have a damper arrangement, wherein the damper arrangement is arranged on the hinge arm, wherein the damper arrangement comprises at least two damper parts, wherein a first damper part can be moved relative to a second damper part, wherein all the parts of the damping arrangement can be moved relative to the hinge arm.

In addition to the first damper part and the second damper part, the damper arrangement comprises a deformation element, e.g. a spring, which is fitted on one of the two damper parts. It is possible, for example, during a closing movement of the hinge, for the deformation element to be subjected to stressing and subjected to the action of force, in addition to providing a damping effect.

The damper arrangement is preferably arranged in the inner volume of the housing. It is advantageous if the adjustment element has, for example, an aperture, in order to support the second damper part of the damping arrangement, both in the closed state and in the open state of the hinge.

The first damper part preferably has one end butting permanently against the coil of the spring element. The coil of the spring element here preferably limits the movement of the damper arrangement in the direction of the hinge cup. This means that the first damper part is movable relative to the second damper part in the housing only in the direction counter to the hinge cup.

It is also advantageous for the second articulated lever to comprise a hook, wherein the second damper part has a carry-along portion, which is compatible with the hook, wherein, during movement of the hinge cup relative to the hinge arm, the hook engages in the hook-compatible carry-along portion on the second damper part.

The hook is advantageously arranged on the outer side of the second articulated lever.

In the closed position of the hinge, the damper arrangement, in particular, the second damper part, is preferably limited, for example, in terms of movement in the direction counter to the hinge cup in the the hook of the second articulated lever engages in the hook-compatible carry-along portion. Also in the closed position of the hinge, the deformation element has preferably been subjected to stressing and for example part of the first damper part is accommodated in the second damper part.

During the opening movement of the hinge, the second articulated lever with the hook can advantageously be pivoted about the third bearing element such that the hook can be moved out of the hook-compatible carry-along portion on the second damper part. As a result, the movement of the damper arrangement in the housing in the direction counter to the hinge cup is advantageously no longer limited. The deformation element can then preferably be relieved of stressing, and the second damper part can be moved relative to the first damper part, wherein for example the first damper part is moved out of the housing of the second damper part. The second damper part can advantageously be moved here in the direction counter to the hinge cup.

During the movement of the hinge cup relative to the hinge arm, the hook can advantageously be moved along the side parts of the housing in the direction of the upper side of the housing, wherein the hook engages laterally behind the hook-compatible carry-along portion on the second damper part.

During the closing movement of the hinge, the hook can preferably be moved, on the second damper part, on the inner side of the side parts of the housing in the direction of the inner side of the upper side of the housing. The hook here advantageously engages behind the hook-compatible carry-along portion on the second damper part, and, therefore, the second damper part can be moved in the direction of the hinge cup. Therefore, for example, the first damper part can be pushed into the housing of the second damper part and, in the process, the deformation element is subjected to stressing, in which case the closing movement of the hinge is subjected to the action of force and damped.

The present invention extends to a piece of furniture having a basic furniture structure on which a movable furniture part is present, wherein the movable furniture part is accommodated on the basic furniture structure by way of a hinge according to one of the variants described above.

BRIEF DESCRIPTION OF THE DRAWINGS

Further features and advantages of the present invention will be explained in more detail hereinbelow with reference to schematically illustrated exemplary embodiments of the present invention.

DETAILED DESCRIPTION OF THE INVENTION

Figure 1:
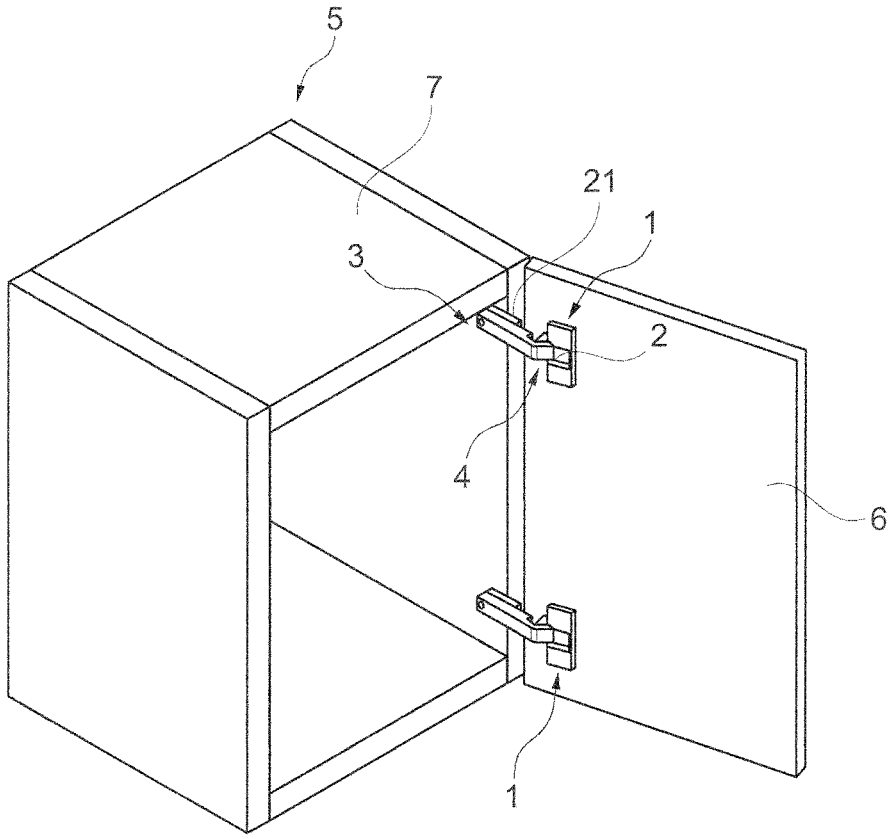
FIG. 1 shows a perspective view of a piece of furniture having two hinges, with a movable furniture part in an open position.

A hinge 1 according to the present invention comprises a hinge cup 2, a hinge arm 3 and an articulation mechanism 4. In the mounted state, the hinge cup 2 and hinge arm 3 are each fitted, for example, on the piece of furniture 5, preferably the hinge cup 2 is fitted on the movable furniture part 6 and the hinge arm 3 is fitted on the basic furniture structure 7 (see FIG. 1). FIG. 1 here illustrates an open position of the piece of furniture 5 and of the hinge 1, along with two hinges 1 according to the present invention.

Figure 3:
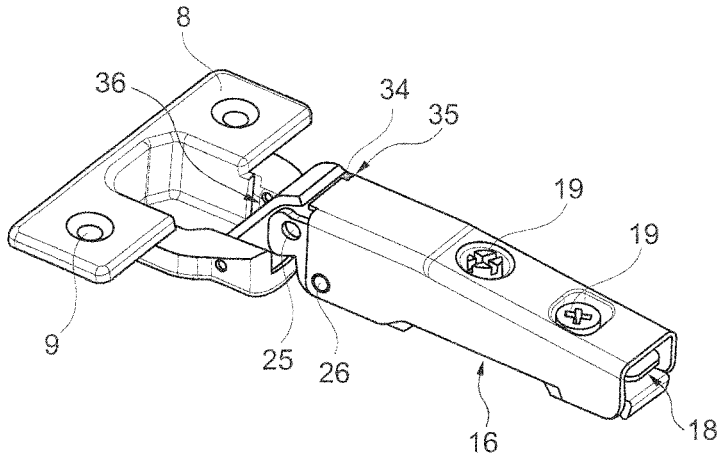
FIG. 3 shows an assembled hinge according to FIG. 2.

The hinge cup 2 has arranged on it mounting flanges 8, which each have an aperture 9, e.g. in the form of a through-hole, for mounting means, e.g. screws (see FIG. 3), for connecting the hinge cup 2 in a releasable manner to the movable furniture part 6. The hinge cup 2 is preferably designed such that the hinge cup 2 can be introduced into a cutout in the piece of furniture 5, wherein a floor 10 of the hinge cup 2 can rest on a floor of the cutout in the piece of furniture 5 (see FIG. 1). In the mounted state, the mounting flanges 8 butt against an outer surface of the piece of furniture 5, preferably of the movable furniture part 6. In a closed position of the piece of furniture 5, the outer surface of the piece of furniture 5 is preferably directed toward an inner volume of the basic furniture structure 7.

The hinge arm 3 comprises a housing 11, an adjustment element 12 and a connecting element 21. The housing 11 has two side parts 13 and an upper side 14, wherein the sides 13, 14 of the housing 11 are arranged so as to form a U shape (see FIG. 2). The sides 13, 14 of the housing 11 comprise in each case 6 surfaces, wherein preferably two sides of the housing 11 are main sides 15, which extend along the length and width, wherein preferably two sides of the housing 11 are secondary sides 16 (see FIG. 3), which extend along the length and height, and wherein preferably two sides of the housing 11 are end sides 17 (see FIG. 4), which extend along the width and height. The housing 11 can be a component in one or more parts and is preferably formed from plates, e.g. metal plates.

The sides 13, 14 of the housing 11 form an inner volume 18 (see FIG. 3), in that the adjustment element 12 can be accommodated. The adjustment element 12 here is arranged between the housing 11 and connecting element 21. Adjustment mechanisms 19, e.g. screws, can be used to adjust the height and the left-right position of the movable furniture part 6 relative to the basic furniture structure 5. The adjustment mechanisms 19 engage, for example, through holes 20 in the housing 11 and connect the housing 11 to the adjustment element 12 (see FIG. 2).

The connecting element 21 can be connected to the piece of furniture 5 in a releasable manner to the piece of furniture 5 preferably by way of mounting means, e.g. screws (see FIG. 1).

Figure 2:
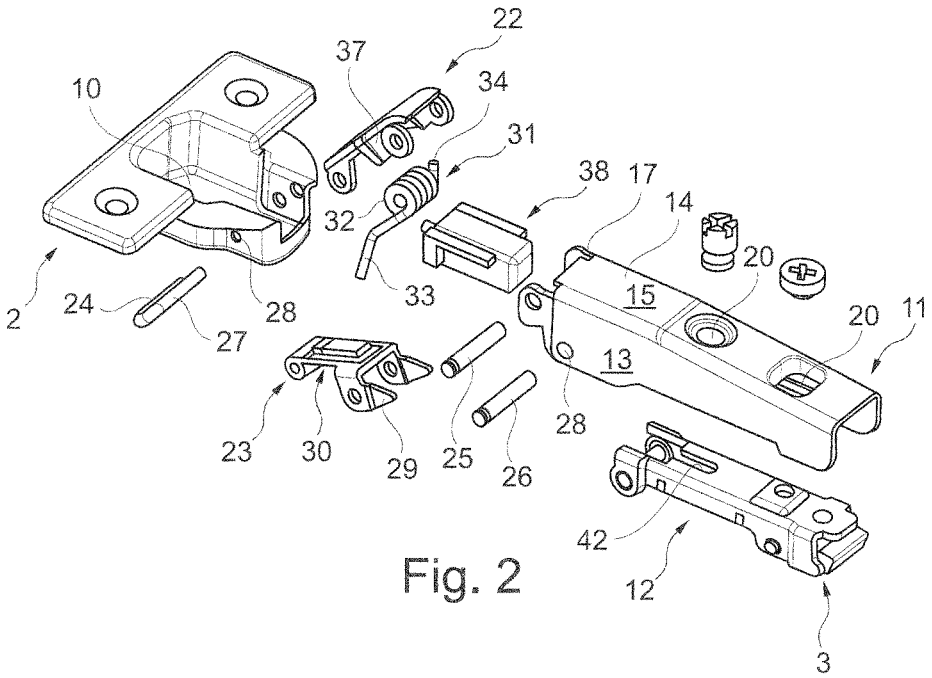
FIG. 2 shows an exploded illustration of the hinge according to the present invention.

The articulation mechanism 4 comprises at least one articulated lever, preferably two articulated levers 22, 23, and at least two, preferably four, bearing elements 24, 25, 26, 27 (see FIG. 2). The first articulated lever 23 here has a first end attached to the hinge cup 2 by way of a first bearing element 24 and has a second end attached to the housing 11 of the hinge arm 3 by way of the second bearing element 25. The second articulated lever 22 has a first end attached to the hinge cup 2 by way of the fourth bearing element 27 and has the second end attached to the hinge arm 3 by way of the third bearing element 26. The housing 11 of the hinge arm 3 and the hinge cup 2 each have at least one mount, preferably two mounts 28 for the bearing elements 24, 25, 26, 27, and therefore the bearing elements 24, 25, 26, 27 connects the hinge cup 2 and the hinge arm 3 to the articulated levers 22, 23. The bearing elements 24, 25, 26, 27 are, for example, rivets, bolts, nails and the like. The first bearing element 24 and the fourth bearing element 27 are preferably designed in the form of a single component (see FIG. 2), the two bearing elements 24, 27 being connected to one another via a curved portion.

Figure 8:
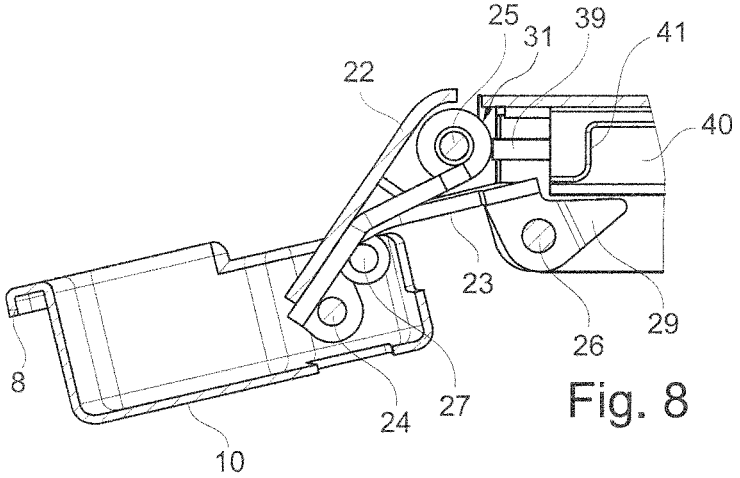
FIG. 8 shows a view of the detail B according to FIG. 7.

Furthermore, a hook 29 is, preferably two hooks 29 are, arranged on the outer side 30 of the second end of the second articulated lever 23 (see FIG. 2). The hook or the hooks 29, along with the second articulated lever 23, can be pivoted about the third bearing element 26 on the hinge arm 2 (see FIGS. 5 and 8).

The hinge 1 according to the present invention likewise has a spring element 31, which is arranged on the second bearing element 25 (see FIG. 2). The second bearing element 25 engages through a hole in the coil 32 of the spring element 31 and connects the spring element 31 in a pivotable manner to the housing 11 of the hinge arm 3 (see FIGS. 4-5). The spring element 31 is covered by the first articulated lever 22. The first articulated lever 22 here has a front side 36 (see FIG. 3) and two cover sides 37 (see FIG. 2). The sides 36, 37 of the first articulated lever 22 can advantageously be used to block the view of the spring element 31 (see FIG. 3). This increases the esthetics of the hinge 1.

Figure 7:
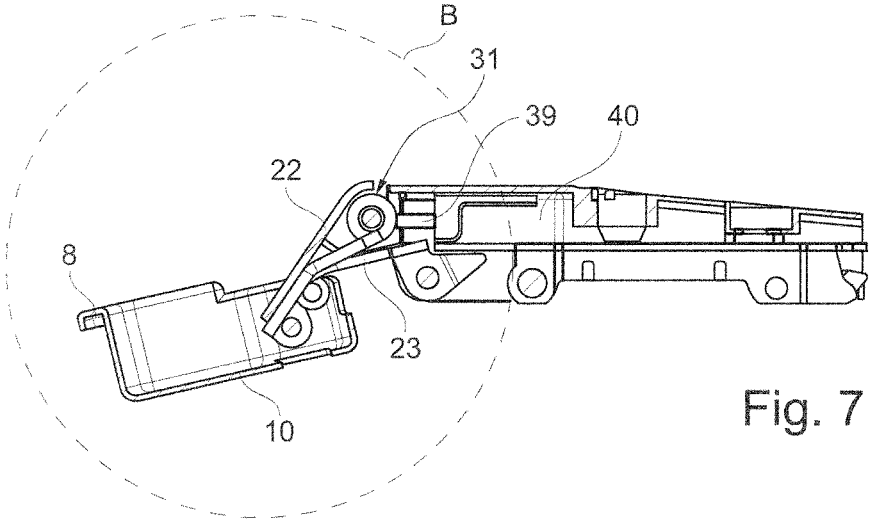
FIG. 7 shows a side view of a hinge with the hinge in an open position.

The spring element 31 is preferably a leg spring and/or a torsion spring, which is coiled, for example, in the counterclockwise direction. The spring element 31 here has legs 33, 34 (see FIG. 2). The legs 33, 34 of the spring element 31 are portions which extend directly from the coil 32 of the spring element 31. The first leg 33 of the spring element 31 is arranged between the first articulated lever 22 and the second articulated lever 23 (see FIG. 4). The first leg 33 of the spring element 31 is preferably permanently in contact with the first articulated lever 22. For example, only a single portion of the first leg 33 of the spring element 31 here is in contact with the first articulated lever 22. The second articulated lever 23 comes into contact with the first leg 33 of the spring element 31 preferably only during an opening movement of the hinge 1 (see FIG. 7). The second leg 34 of the spring element 31 is supported on an end-side surface 17 of the upper side 14 of the housing 11 (see FIG. 3). The upper side 14 of the housing 11 here has a notch 35, in which the second leg 34 of the spring element 31 can be arranged. The longitudinal extent of the second leg 34 of the spring element 31 preferably extends along the end side 17 of the housing 11, and therefore the end surface of the second leg 34 of the spring element 31 is oriented toward the main-side upper side 14 of the housing (see FIG. 3). The legs 33, 34 of the spring element 31 are in the shape, for example, of a cylinder or a prism, wherein the longitudinal extent of the legs 33, 34 corresponds to the height of the cylinder or of the prism. Furthermore, the end surface constitutes a surface area of the cylinder or prism.

It is possible here for the legs 33, 34 of the spring element 31 to be rectilinear or else bent or inflected one or more times along the longitudinal extent.

The hinge 1 has, for example, a damping function during the closing movement of the hinge 1. A damping arrangement 38 is arranged in the housing 11 of the hinge arm 3 (see FIG. 2). The damping arrangement 38 comprises a first damper part 39, a second damper part 40 and a deformation element (see FIGS. 5 and 8). The second damper part 40 has a carry-along portion 41, which is designed such that the hook 29 of the second articulated lever 23 can engage on the carry-along portion 41.

The deformation element is preferably a spring (not illustrated), which is arranged in the casing of the second damper part 40. During movement of the hinge 1, the first damper part 39 is moved relative to the second damper part 40 and the deformation element is subjected to stressing or relieved of stressing.

Figure 4:
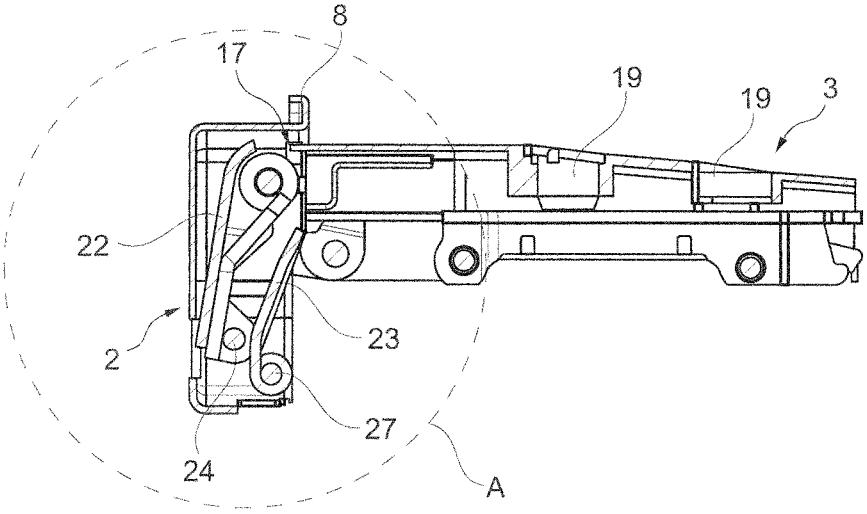
FIG. 4 shows a side view of a hinge according to FIGS. 2 and 3 with the hinge in a closed position.
Figure 5:
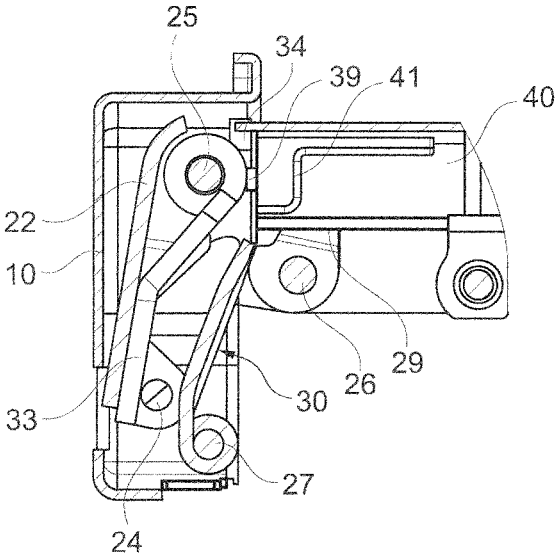
FIG. 5 shows a view of the detail A according to FIG. 4.

FIGS. 4 and 5 show the hinge 1 according to the present invention in the closed position of the hinge 1. The two articulated levers 22, 23 and the spring element 31 here are accommodated in the hinge cup 2. The hook 29 of the second articulated lever 23 is accommodated in the housing 11. The hook 29 of the second articulated lever 23 engages behind the carry-along portion 41 of the second damper part 40, and, therefore, the hook 29 limits the second damper part 40 in terms of movement in the direction counter to the hinge cup 2. Furthermore, the coil 32 of the spring element 31 limits the movement of the first damper part 39 in the direction of the hinge cup 2. In the closed position of the hinge 1, the deformation element has been subjected to stressing, and subjected to the action of force, and the two damper parts 39, 40 have been pushed one inside the other.

Figure 6:
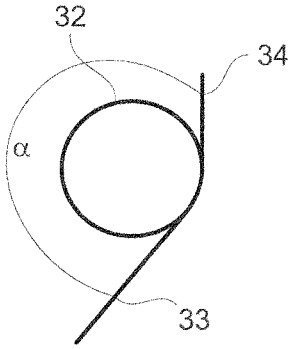
FIG. 6 shows a schematic view of a spring element in the closed position of the hinge according to FIGS. 4 and 5.

In the closed position of the hinge 1, the spring element 31 has its first leg 33 supported on that side of the first articulated lever 22 which is located opposite the front side 36, wherein the front side 36 of the first articulated lever 22 extends along the floor 10 of the hinge cup 2. The second leg 34 of the spring element 31 is supported on the notch 35 of the upper side 14 of the housing 11. The spring element 31 here is in the state in which it has been relieved of stressing, and the angle $\alpha$ enclosed between the longitudinal extent of the two legs 33, 34 is, for example, 90°-180°, preferably 130°-160° (see FIG. 6).

During the opening movement of the hinge 1 or of the piece of furniture 5, the hinge cup 2, which is connected to the movable furniture part 6, can be pivoted about the bearing elements 24, 25, 26, 27. The second articulated lever 23 here approaches the first leg 33 of the spring element 31 until contact is made between the second articulated lever 23 and the first leg 33 of the spring element 31 (see FIGS. 7 and 8). The inner side of the second articulated lever 23 here is in contact with a region of the first leg 33 of the spring element 31. The spring element 31 is subjected to stressing.

During the opening movement of the hinge 1, the hook 29 of the second articulated lever 23 can be pivoted about the third bearing element 26, it being possible here for the hook 29 to be pivoted out of the carry-along portion 41 on the second damper part 40. As a result of the hook 29 being pivoted out, the damping arrangement 38 is no longer limited in terms of movement in the direction counter to the hinge cup 2. It is thus possible for the deformation element, which has been subjected to stressing, to be relieved of stressing, and, therefore, the second damper part 40 can be moved within the housing 11 in the direction counter to the hinge cup 2. During movement of the hinge 1, the first damper part 39 is preferably permanently in contact with the coil 32 of the spring element 31. During the closing movement of the hinge 1, the hook 29 of the second articulated lever 23, by pivoting about the third bearing element 26, engages behind the hook-compatible carry-along portion 41 on the second damper part 40, and the second damper part 40 is moved in the direction of the hinge cup 2. It is possible here for the first damper part 39 to be pushed into the second damper part 40, which causes the closing movement of the hinge 1 to be damped.

Both in the open position and in the closed position of the hinge 1, the second damper part 40 can be supported by the adjustment element 12. So that the movement of the second damper part 40 is not obstructed by the adjustment element 12, the adjustment element 12 has an aperture 42 for the second damper part 40.

Figure 9:
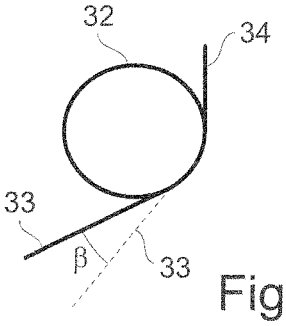
FIG. 9 shows a schematic view of a spring element in the open position of the hinge according to FIGS. 7 and 8.

During the opening movement of the hinge 1, the spring element 31 can be subjected to stressing, and subjected to the action of force. During the opening movement of the hinge 1, the second leg 34 of the spring element 31 butts for support against the housing 11. It is only the first leg 33 of the spring element 31 which is deflected, by the pivoting movement of the articulated levers 22, 23, counter to the coiling direction of the spring element 31, which is coiled to the left. The angle or the angle of rotation $\beta$ about which the first leg 33 is deflected is between 10° and 60°, and is preferably less than 45°. In FIG. 9, a solid line is used to illustrate the first leg 33 in the open position of the hinge 1 and a dashed line is used to illustrate the first leg in the closed position of the hinge 1.

In the open position of the hinge 1, the spring element 31 has been subjected to the action of force, and gives rise to a pulling-closed force of the hinge 1.

LIST OF REFERENCE SIGNS

1 Hinge
2 Hinge cup
3 Hinge arm
4 Articulation mechanism
5 Piece of furniture
6 Furniture part
7 Basic furniture structure
8 Mounting flange
9 Aperture
10 Floor
11 Housing
12 Adjustment element
13 Side parts
14 Upper side
15 Main side
1 Secondary side
17 End side
18 Inner volume
19 Adjustment mechanism
20 Holes
21 Connecting element
22 Articulated lever
23 Articulated lever
24 Bearing element
25 Bearing element
26 Bearing element
27 Bearing element
28 Mounts
29 Hook
30 Outer side
31 Spring element
32 Coil
33 Leg
34 Leg
35 Notch

36 Front side
37 Cover sides
38 Damping arrangement
39 Damper part
40 Damper part
41 Carry-along portion
42 Aperture

The invention claimed is:

1. A hinge for connecting a movable furniture part of a piece of furniture in a movable manner to a basic furniture structure of the piece of furniture, the hinge comprising:

a hinge cup;

an articulation mechanism; and a hinge arm, wherein the hinge cup is connected to the hinge arm in a pivotable manner via the articulation mechanism, wherein the articulation mechanism comprises a first and a second articulated lever, wherein the articulated levers are attached to the hinge cup and to the hinge arm such that the hinge is a four-link hinge, wherein the first articulated lever has a first end that is connected to the hinge cup in a pivotable manner via a first bearing element, and a second end that is connected to the hinge arm in a pivotable manner via a second bearing element, wherein the second articulated lever has a first end that is connected to the hinge cup in a pivotable manner via a fourth bearing element, and a second end that is connected to the hinge arm in a pivotable manner via a third bearing element, wherein, in a closed position of the hinge, the first articulated lever is present between a floor of the hinge cup and the second articulated lever, wherein a spring element is arranged on the second bearing element, wherein a first leg of the spring element is arranged between the first articulated lever and the second articulated lever, wherein, during a closing movement of the hinge cup relative to the hinge arm, the first leg of the spring element is supported on the first articulated lever, and wherein a second leg of the spring element is supported on the hinge arm, and wherein the spring element is configured so as to provide a pulling-closed force of the hinge during the closing movement of the hinge cup relative to the hinge arm.

2. The hinge according to claim 1, wherein a longitudinal extent of the second leg of the spring element is shorter than a longitudinal extent of the first leg of the spring element.

3. The hinge according to claim 1, wherein the hinge arm comprises a housing, the housing has two side parts and an upper side such that the housing is U-shaped, wherein the upper side has six surfaces, wherein two surfaces of the upper side are main sides, which extend along the width and length, wherein two surfaces of the upper sides are secondary sides, which extend along the height and length, wherein two surfaces of the upper side are end sides, which extend along the width and height, and wherein the second leg of the spring element is supported on an end-side of the upper side of the housing.

4. The hinge according to claim 3, wherein the upper side of the housing has a notch, and wherein the second leg of the spring element butts against the notch.

5. The hinge according to claim 3, wherein the second leg of the spring element is present in such a manner that a longitudinal extent of the second leg extends along an end side of the upper side of the housing.

6. The hinge according to claim 3, wherein an end surface of the second leg is supported on the upper side of the housing, and wherein the end surface of the second leg is present in a direction transverse to a longitudinal extent of the second leg of the spring element.

7. The hinge according to claim 3, wherein the hinge further comprises a damper arrangement, wherein the damper arrangement is arranged on the hinge arm, wherein the damper arrangement comprises at least two damper parts, wherein a first damper part can be moved relative to a second damper part, and wherein all the parts of the damping arrangement can be moved relative to the hinge arm.

8. The hinge according to claim 7, wherein the second articulated lever comprises a hook, wherein the second damper part has a carry-along portion, which is compatible with the hook, and wherein, during movement of the hinge cup relative to the hinge arm, the hook engages in the hook-compatible carry-along portion on the second damper part.

9. The hinge according to claim 8, wherein, during movement of the hinge cup relative to the hinge arm, the hook can be moved along the side parts of the housing in the direction of the upper side of the housing, and wherein the hook engages laterally behind the hook-compatible carry-along portion on the second damper part.

10. The hinge according to claim 1, wherein, in a state in which the spring element has been relieved of stressing, the first and second legs of the spring element extending directly from the coil enclose an angle between 90 and 180°.

11. The hinge according to claim 1, wherein, during a movement of the hinge cup relative to the hinge arm, the spring element can be subjected to stressing, such that a difference in an angle which is enclosed by the first and second legs changes over a range from 10° to 60° from a stress-relieved state to a stressed state.

12. A piece of furniture having a basic furniture structure on which a movable furniture part is present, wherein the movable furniture part is accommodated on the basic furniture structure via the hinge according to claim 1.

13. The hinge according to claim 1, wherein the hinge arm comprises a housing, an adjustment element and a connecting element, wherein the adjustment element is present between the housing and the connecting element, and wherein the connecting element can be connected to the piece of furniture.

14. A hinge for connecting a movable furniture part of a piece of furniture in a movable manner to a basic furniture structure of the piece of furniture, the hinge comprising:

a hinge cup;

an articulation mechanism; and a hinge arm, wherein the hinge cup is connected to the hinge arm in a pivotable manner via the articulation mechanism, wherein the articulation mechanism comprises a first and a second articulated lever, wherein the articulated levers are attached to the hinge cup and to the hinge arm such that the hinge is a four-link hinge, wherein the first articulated lever has a first end that is connected to the hinge cup in a pivotable manner via a first bearing element, and a second end that is connected to the hinge arm in a pivotable manner via a second bearing element, wherein the second articulated lever has a first end that is connected to the hinge cup in a pivotable manner via a fourth bearing element and a second end that is connected to the hinge ail in a pivotable manner via a third bearing element, wherein a spring element is arranged on the second bearing element, wherein a first leg of the spring element is arranged between the first articulated lever and the second articulated lever, wherein, during a closing movement of the hinge cup relative to the hinge arm, the first leg of the spring element is supported on the first articulated lever, wherein the hinge arm comprises a housing, an adjustment element, and a connecting element, wherein the adjustment element is present between the housing and the connecting element, wherein the connecting element can be connected to the piece of furniture, wherein a second leg of the spring element is supported on the hinge arm, wherein the spring element is configured so as to provide a pulling-closed force of the hinge during the closing movement of the hinge cup relative to the hinge arm, wherein in a closed position of the hinge, the first articulated lever is present between a floor of the hinge cup and the second articulated lever, wherein a second spring element is arranged on the second bearing element, wherein a first leg of the second spring element is arranged between the first articulated lever and the second articulated lever, wherein, during a closing movement of the hinge cup relative to the hinge arm, the first leg of the second spring element is supported on the first articulated lever, wherein a second leg of the second spring element is supported on the hinge arm, wherein the spring element is configured to provide a pulling-closed force of the hinge during the closing movement of the hinge cup relative to the hinge arm.

* * * * *